United States Patent [19]

Tran-Quang

[11] 3,942,059

[45] Mar. 2, 1976

[54] HIGH POWER X-RAY TUBE

[75] Inventor: Dang Tran-Quang, Paris, France

[73] Assignee: Compagnie Generale de Radiologie, Paris, France

[22] Filed: June 12, 1974

[21] Appl. No.: 478,709

[30] Foreign Application Priority Data

June 29, 1973 France ..... 73.24042

[52] U.S. Cl. ..... 313/60; 313/39

[51] Int. Cl.[2] ..... H01J 35/04

[58] Field of Search ..... 313/60

[56] References Cited

UNITED STATES PATENTS

| | | | |
|---|---|---|---|
| 2,597,498 | 5/1952 | Kerkhoff | 313/60 X |
| 3,753,021 | 8/1973 | Braun | 313/60 |
| 3,836,805 | 9/1974 | Kok | 313/60 |

*Primary Examiner*—John Kominski
*Assistant Examiner*—Darwin R. Hostetter
*Attorney, Agent, or Firm*—Edwin E. Greigg

[57] ABSTRACT

An X-ray tube with a rotating, motor-driven anode made up from a disc of graphite covered on a major portion of its convex surface which is turned away from its axis of rotation by a layer of an X-ray emissive refractory metal or alloy which has a much lower coefficient of thermal emissivity than the other face of graphite. To reduce thermal radiation in the direction of the rotor to which the anode is secured, the X-ray emissive, convex, covered surface of the anode, which is subjected to electron bombardment, is turned toward the rotor and the cathode lies on the same side of the anode as the rotor of the driving motor, resulting in reduced operational temperatures of these parts. Additional thermal protection for the rotor and bearing is afforded by providing a reflective surface on the rotor or by installing a protective disc-shaped shield between the rotor and the anode. The reduced temperatures of rotor and bearing permit increased output power and lengthened operating periods of the X-ray tube. In addition, a coolant may be circulated through the hollow anode shaft to further reduce the bearing temperatures.

5 Claims, 6 Drawing Figures

26
23
22
25
21
33
34
31
30
35
41
32
36
38
40
37
39
28
29
20

26
23
22
25
21
33
47
46
34
49
35
50
48
32
43
36
37
40
39
44
43
45
28
29
20

HIGH POWER X-RAY TUBE

BACKGROUND OF THE INVENTION

The invention relates to a high power X-ray tube and especially to an X-ray tube of the type having a rotating anode which is capable of a high power emission during prolonged periods.

The radiated power and the length of operation (endurance) of an X-ray tube are limited by the temperature of the anode which receives the energy of the electron beam. In order to limit that temperature, it is known to improve the heat dissipation either by conduction or by radiation; if by conduction, it is done by increasing the mass of the anode with respect to the target area struck by the cathode rays, and if by radiation, it is done by increasing the radiating surface and by choosing a material for that surface which is endowed with a good coefficient of thermal emissivity (black body). In general, the principal problem to be solved in X-ray tubes is that of heat removal. This fact has led to the solution of employing tubes with rotating anodes, where the mass of the anode is very large with respect to the dimensions of the target and where the thermally radiating surface area, made up by the two faces of the anode plate, is quite large.

OBJECTS AND SUMMARY OF THE INVENTION

It is a first object of the present invention to provide an X-ray tube with rotating anode, capable of greater output power and endurance than knonw X-ray tubes of comparable dimensions.

It is a second object of the present invention to provide an X-ray tube which is more robust and stronger than known X-ray tubes with rotating anodes.

To achieve these and other objects, an extended study was made of different operating conditions and of their mutual influences and this study has led to operational parameters of construction which are different from those presently used and has resulted in creating a new X-ray tube with a rotating anode which possesses properties of power and robustness which are a clear improvement over the known tubes.

The characteristics of this new X-ray tube and the results of tests performed with an exemplary, but non-limiting embodiment thereof will become apparent from the following description and the several figures of the drawing.

GENERAL DESCRIPTION OF THE INVENTION

Figure 1:
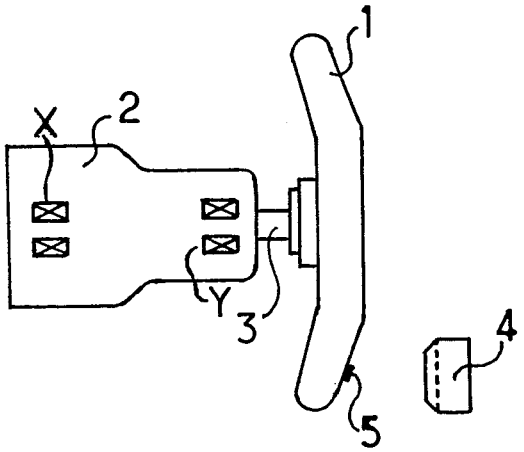
FIG. 1 is a schematic view of a portion of an X-ray tube of known construction having a rotating anode.

A generalized, schematic picture of an X-ray tube with rotating anode is shown in FIG. 1 including an anode plate 1 and a hollow motor armature rotor 2 which supports the anode on a shaft 3. The rotor is supported in two interior bearings X and Y integral with a fixed axis, not shown. A cathode 4 emits an electron beam which strikes an inclined portion of the anode along a focal track or circular path 5. Thus, in this known solution, the cathode and hence the track exposed to the electron beam both lie on the side of the anode opposite to the rotor.

Increasing the surface and the mass of the anode brings a double advantage. Firstly, the heat of the target is removed by conduction, which heats up the entire mass of the anode; thus, the greater the mass of the anode, the lower will be the temperature of the target. Secondly, the entire surface of the anode (on both sides) thus heated up dissipates the heat by radiation and, the larger the surface, the greater the amount of heat energy radiated away.

This dissipation of heat by radiation occurs according to the following formula:

$$W = \epsilon \sigma s (T - T_o)^4 \quad (1)$$

where:

$W$ is the radiated power $\epsilon$ is the coefficient of thermal emissivity of the body $s$ is the radiating surface area, and $\sigma$ is the Stefan - Boltzman constant $T$ and $T_o$ are, respectively, the absolute temperatures of the radiating body and its environment.

Thus, it would be advantageous, firstly to increase the coefficient of thermal emissivity, that is, to use as the anode plate a body whose properties, as nearly as possible, approach those of a black body; graphite is well suited from this point of view. Next, it would be suitable to increase the emitting surface area, i.e., as already explained above, to increase the dimensions of the anode plate. Finally, experience has shown that, in order to increase the temperature of the radiating body, i.e., the anode plate, with respect to that of the target, and, hence, in order to increase the radiated energy, it is useful to increase the linear speed of the target.

Thus, one finds that, for a particular anode, the power which can be obtained, is given by the following formula:

$$W = K \cdot R \sqrt{n} \quad (2)$$

where:

$W$ is the power obtained from the anode $K$ is a constant coefficient for a given tube $R$ is the radius of the anode plate $n$ is the number of anode revolutions per unit time Thus, it is important to increase simultaneously the dimension and the speed of the anode, which tends to overload the bearings. The sensitive problem encountered with rotating anodes is that of the temperature of the bearing nearest the anode (labeled Y in FIG. 1). At that location, heat arrives both by radiation and also by conduction along the anode shaft 3. In order to reduce, as much as possible, this heat transfer toward the bearing, the bearing may be placed at some distance from the anode plate. This separation is limited, however, by the overhanging shaft which may oscillate during its rotation. At the same time, the shaft 3 is given a minimum diameter in order to increase its thermal resistance, reducing its strength.

The reduction of the heat transfer by radiation from the anode to the bearing closest to the anode also poses problems. Modern anodes are generally constructed as graphite plates on which is affixed a metallic or alloy target surface acting as a source of X-rays; the metals making up the target surface are chosen from a class of high atomic number, X-ray emissive, refractory metals such as tungsten, rhenium or molybdenum as taught by U.S. Pat. Specifications Nos. 2,863,083 of SCHRAMM and 3,539,839 of BOUGLE assigned to the present Assignee. For technical reasons, the application of the track can only be done by deposition in the vapor phase over the entire surface of the anode plate; a deposit over a limited width (corresponding approximately to the width of the track) would cause the formation of irregularities in the surface, at the fringes of the deposition, and this would tend to favor the formation of electric arcs. This overall deposition greatly diminishes the thermal power radiated by the anode plate, because, even though graphite has a very high coefficient of thermal emissivity and thus is almost a black body, this is not the case for the X-ray emissive refractory metals deposited thereon which radiate very poorly.

This reduction of the thermal radiative capabilities of the anode, which is caused by the metallization of an entire face, has even more serious results when that face of the anode which has maintained its high emissivity faces in the direction of the rotor and of bearing Y whose temperature is critical. This situation is a result of the fact that it is very difficult to place the cathode, and hence also the metallic anode coating, on the same side of the anode plate as the driving motor. Actually, there would be serious risks of electrical breakdown between the rotor and the cathode as these parts would be too close to one another in view of the high potential differences between them. It has been attempted to separate the cathode from the rotor as far as possible in order to diminish these risks, but this calls for an increase in the diameter of the anode plate, which, in turn, causes an increase of the dimension of the shaft 3 supporting it, and hence tends to increase the temperature of bearing Y, whose stress is already made greater by increasing the dimensions of the anode plate.

Thus, the achievement of an X-ray tube with rotating anode is a compromise among several opposing conditions. The invention rests on the results of extensive quantitative tests, the results of which are now described.

In a first, systematic, evaluative test, the test subject was an X-ray tube with rotating anode, of the type shown in FIG. 1, with an anode made of graphite, of 120 mm diameter, and coated with a refractory material X-ray emissive metal or alloy on the face exposed to the electron beam emitted by the cathode. The tube was energized so as to obtain an equilibrium temperature at the anode of 1,400° C and the temperatures of the bearings were measured as a function of time.

The measured temperatures were actually those of bearing X and not those of bearing Y for the convenience of the experiment, but the temperature differences between bearings X and Y had previously been measured and it had been found that there was a difference of 50° C when bearing X had a temperature of 600° C and a difference of 30° C when bearing X had a temperature of 300° C; bearing Y being at the higher temperature.

Figure 2:
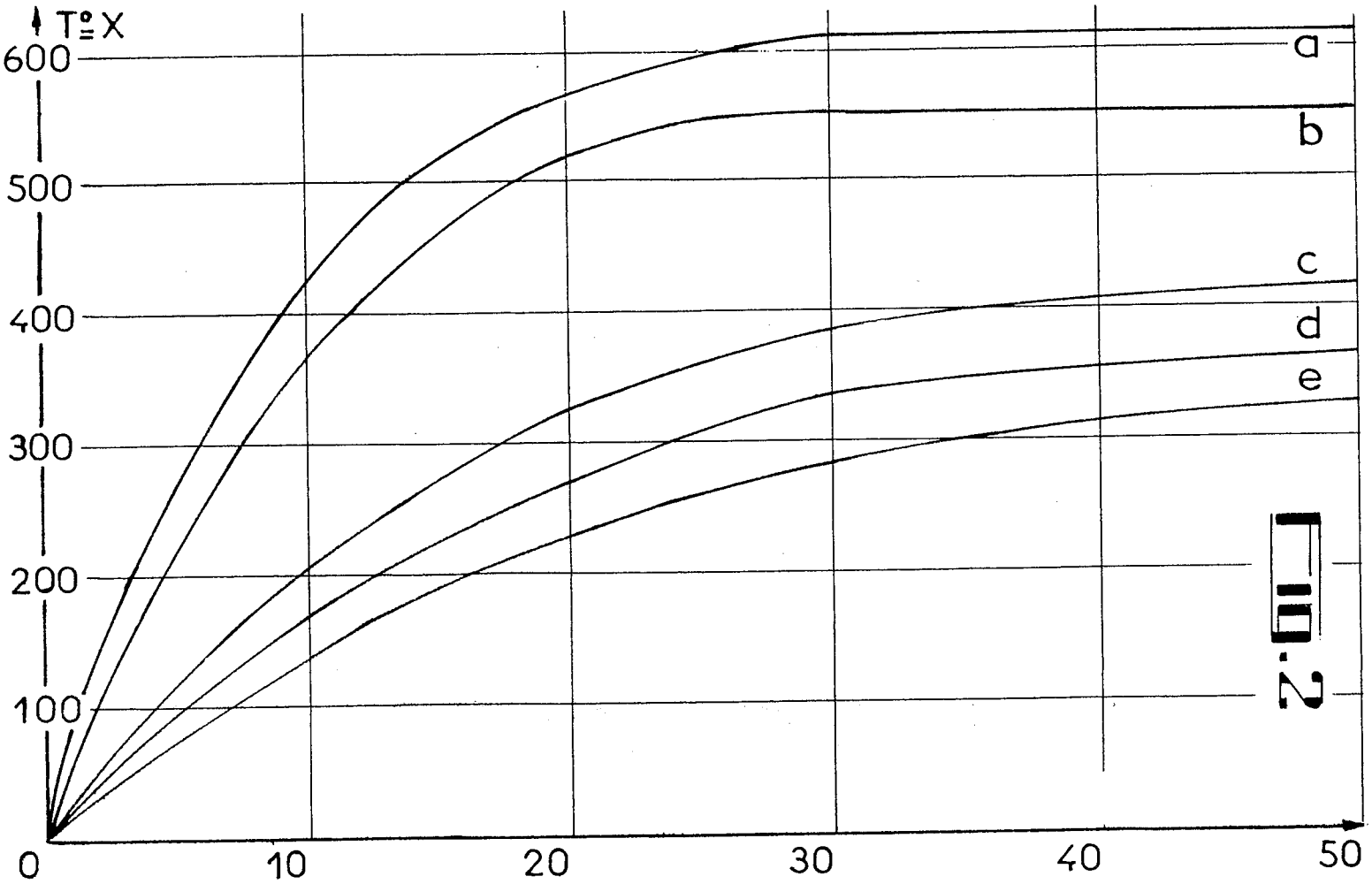
FIG. 2 is a family of curves giving the temperatures of the rotor bearings of the anode as a function of time of operation, for various tube configurations.

The curve *a* shown in FIG. 2 shows the temperature rise of this bearing which stabilizes at 610° C after approximately 30 minutes. Next, curve *b* was drawn, given the same temperatures, but after subtraction of the heat transferred from the anode to the rotor by conduction in the shaft 3. The temperature of the bearing stabilized at approximately 550° C at the end of the same time. Thus, it may be seen that the temperature increase due to the conduction along the shaft is relatively small but is not negligible.

Figure 3:
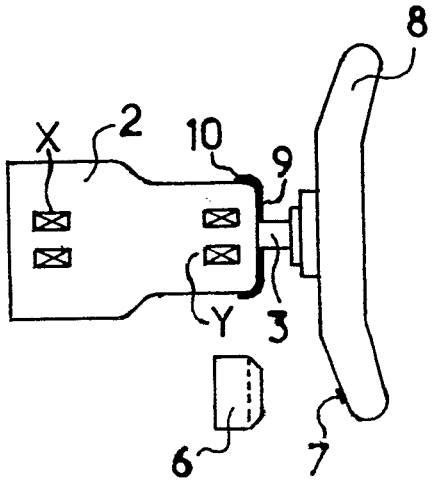
FIG. 3 is a schematic view of a portion of an X-ray section tube with a rotating anode according to one of the embodiments of the invention.

In a second, comparative test, the configuration of the tube was changed to that shown in FIG. 3, by reversing the anode and placing the cathode on the same side of the anode plate as the rotor. FIG. 3 shows the rotor 2 with its shaft 3, both identical to those of FIG. 1, the anode plate 8 with its convex face turned toward the rotor and cathode 6 emitting its beam onto track 7. Special precautions were taken in order to prevent electrical breakdown between cathode 6 and rotor 2 during the experiment.

These precautions consisted in limiting the potential difference between cathode 6 and rotor 2 beneath the voltage which would cause this breakdown owing to the distance between cathode and rotor. Thus, the cathode emitting power was obtained by acting upon the filament temperature, that is to say, upon the intensity through this filament.

Curve *c* of FIG. 2 shows the temperature of bearing Y as a function of time with this tube disposition. The measured temperatures are clearly lower than those obtained with the preceding configuration, because, in this case, the side of the anode plate facing the rotor is covered with a reflecting layer of the above-mentioned X-ray emissive refractory metal whose thermal emissivity is much lower than that of graphite. Furthermore, the edges of the face of anode plate opposite the one covered by the X-ray emissive layer are slightly inclined toward the axis of rotation and thus this face of, the anode plate constitutes a kind of concave mirror which tends to concentrate the heat rays emitted by its surface toward the axis. In present tubes, the concave face of the anode is generally turned towad the rotor, whereas with the new arrangement shown in FIG. 3, the concavity is in the inverse sense. Thus, it may be seen that the thermal radiation impinging on the rotor is diminished, firstly, by changing the nature of the emitting surface, in this case to the aforementioned X-ray emissive metal coating with a low coefficient of thermal emissivity with respect to that of graphite, and secondly, by the reverse orientation of the anode plate which now concentrates its thermal radiation in the direction opposite to the rotor.

In subsequent experiments, the energy transmitted to the rotor by radiation was further reduced by providing the side of the rotor facing the anode with a polished surface 9 and 10 (FIG. 3). For example, the polished surface may extend over approximately one-fifth of the rotor surface facing the anode. This produced curve *d* (FIG. 2).

In order to further improve the apparatus, the polished surface of the rotor at 9 was replaced by a reflector. These results are shown in curve *e* (FIG. 2), and they show another noticeable decrease of the bearing temperature. The study of curves *a*, *b*, *c*, *d* and *e* shows that the reversal of the anode produces a considerable lowering of the bearing temperature once the tube operation has stabilized: from approximately 610° C to 330° C. But it may especially be noticed that the temperature rise is always much slower with this new embodiment than previously. When the tube operation is limited to 20 minutes, the bearing temperatures are 570° C and 230° C, respectively; the difference is therefore still greater.

This fact has been exploited to increase the diameter of shaft 3. Thus, it was possible to use an anode of greater diameter since it was carried by a stronger shaft and by a bearing which was better protected. The increase of the anode diameter made it possible to locate the cathode on the same side as the rotor but sufficiently far away from it, so as to prevent any risk of electrical breakdown between cathode and rotor.

Thus, according to one characteristic of the invention in an X-ray tube with a rotating anode, the cathode is located on the same side of the anode as the rotor, and the anode is covered over most of its surface facing both the cathode and the rotor by a layer of at least one refractory metal.

One result of this arrangement is to completely vacate the space on the other side of the anode, whereas, in the known arrangement, the cathode assembly was located essentially in the prolongation of the axis of rotation of the anode. This fact was exploited in order to extend the axis of the anode on the side opposite to the side on which the rotor is located and to provide there a bearing fixed in the housing. In this manner, the anode is supported by a bearing on both sides thereof instead of being cantilevered. This new arrangement, which greatly improves the support of the anode, makes it possible to increase still further, by a sizable amount, its weight, dimensions and speed.

Nevertheless, the bearing located on the side of the anode opposite to the cathode is exposed to intense thermal radiation, caused, on the one hand, by the nature of the coating on that side of the anode, which is not covered by a refractory metal coating that radiates only a little as is the case on the side facing the cathode, but, on the contrary, is a surface having characteristics approaching those of a black body, usually graphite, and, on the other hand, caused by the form of the anode, which, in the manner of a concave mirror, concentrates its thermal radiation on the shaft. In order to accommodate, at the same time, prolonging the axis of rotation of the anode with the fact that it is exposed to intense radiation, a hollow bearing axis has been used in which a liquid refrigerant is circulated.

According to a variant embodiment of the invention, the bearing shaft is hollow, traverses the anode, is fixed at two ends, and a liquid refrigerant circulates in the interior of the shaft.

DESCRIPTION OF THE PREFERRED EMBODIMENT

Figure 4:
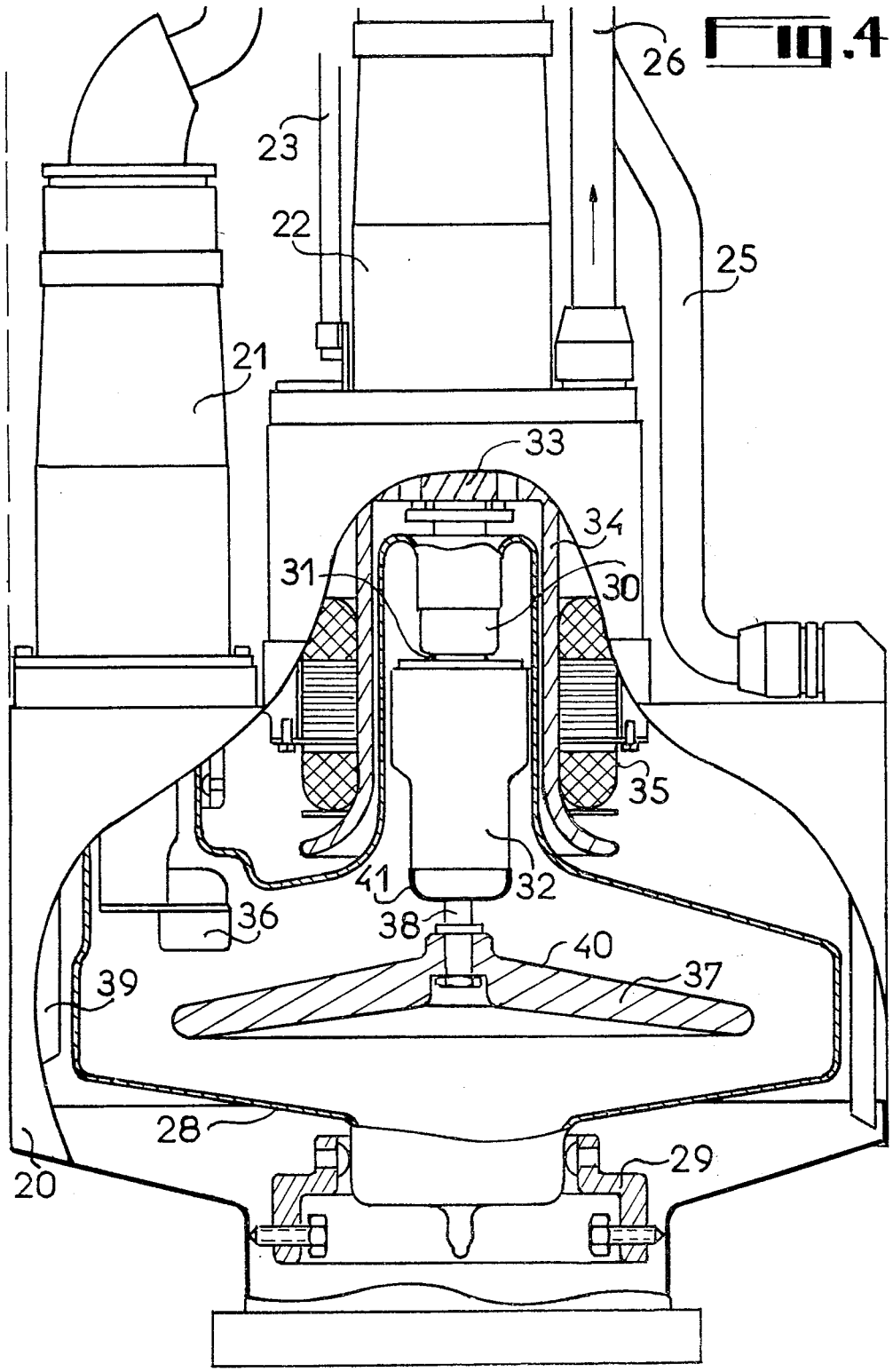
FIG. 4 is a partial section through an X-ray tube according to the invention with an anode located outside of the rotor bearings.

FIG. 4 shows the housing 20 and in its top portion, the high voltage connections 21 and 22 for the cathode and the anode and the connection 23 for the field current of the anode driving motor.

The inlets and outlets for the refrigerant fluid channels are shown at 25 and 26. The protective housing 20 has been opened to show, partially in section, the different constituent elements of the tube. The glass envelope 28 is fixed within the housing at one end by a member 29 clamped by a set of screws pressing against the interior of the housing, and, at the other end, by a weldment 30 on the fixed shaft 31 which supports the bearings of the rotor 32. The support shaft 31 is itself fixed by screws on a plane portion 33 of a member 34 made of insulating material in the form of a flared cylinder. The insulating member 34 is fixed in the interior of the motor field assembly which is itself fixed to the housing 20.

The cathode assembly 36, analogous to that of known X-ray tubes, is located on the same side of the anode as rotor 32. The rotor 32 supports the anode 37 by means of a shaft 38. The anode 37 consists of a graphite plate whose surface 40, facing cathode 36, has been coated with a reflecting layer of the aforementioned X-ray emissive refractory metal or alloy. X-rays generated by the impact of the cathode beam exit through window 39.

A tube is thus created in which the rotor and its bearings are better protected against thermal radiation emitted by the anode, because the anode is concave in the direction opposite to that of the rotor, and that side which faces the rotor is the one which is convex, i.e. turned away from the shaft, and coated with a reflecting layer of X-ray emissive refractory metal with low thermal emissivity. This fact has been exploited in order to increase the diameter of the anode plate and hence the distance separating the power supply of cathode 36 from the field assembly 35, and thus reducing the risk of arcing between cathode and anode.

The thermal protection of the rotor is increased by equipping that part of it lying opposite the anode with a reflective polish 41. This polished surface is obtained by polishing the rotor material and extends onto the cylindrical portion by about 20 mm.

Figure 5:
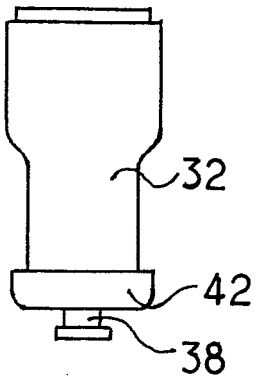
FIG. 5 shows a variant of a portion of the X-ray tube according to FIG. 4.

In a variant embodiment, another increase to the thermal protection of the rotor is achieved by shielding it, as shown in FIG. 5, by means of a protective disc 42, inserted between the anode and the rotor without touching the former made of reflective polished metal and of a size somewhat larger than that of the rotor.

Figure 6:
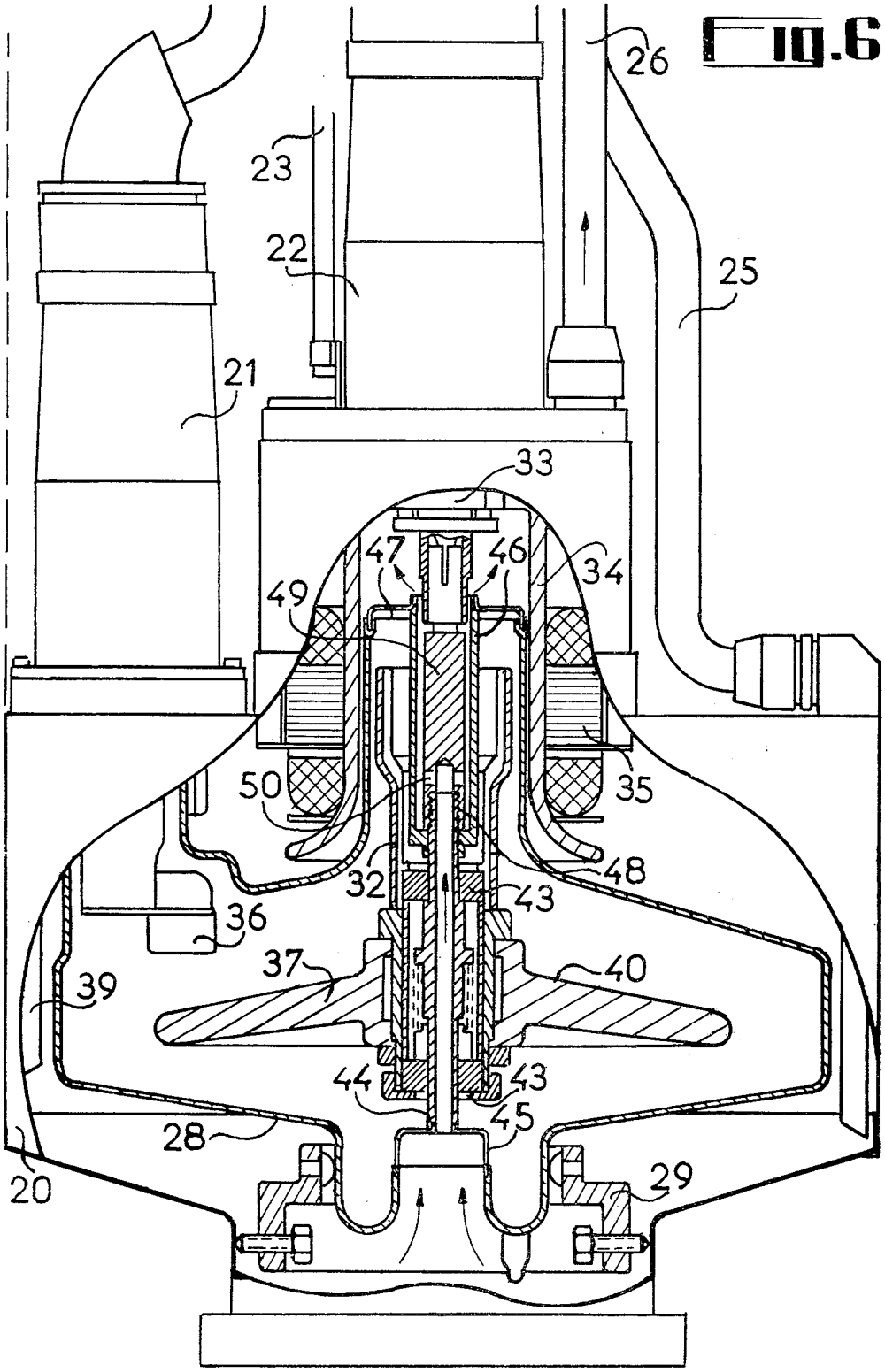
FIG. 6 shows a partial section through an X-ray tube according to the invention having a bearing on each side of the anode with a refrigerant circulating in the interior of the bearing axis.

In another variant, shown in FIG. 6, the support shaft for the anode is fixed at two ends of the tube and carries two bearings 43 located on either side of the anode plate.

FIG. 6 has the same reference numerals for elements common with those of FIG. 4. The anode plate 37 is directly connected to the rotor 32 and is supported by two bearings 43 located on opposite sides of the center of gravity of the assembly. These bearings are mounted on a hollow shaft 44, integral with the glass envelope 28 by means of a cup 45 to which it is welded in a hermetic manner. At its other end, the hollow shaft 44 is affixed to a sleeve 46, also integral with the glass envelope 28 by means of a plate 47. The entire assembly is made integral with the housing 20 by screw engagement at 48 between the threaded end of hollow shaft 44 and the threaded interior of the support shaft 49 attached to a plane portion 33 of the insulating cylinder 34. The support shaft 49 is perforated near its threaded end by openings 50 which permit communication between the interior of the shaft 44 and the interior of the sleeve 46. The refrigerant fluid, arriving through channel 25, is distributed through the housing 20 outside of the envelope 28 and flows into the hollow shaft 44 where it cools the bearings 43. It further flows through openings 50 into the sleeve 46 and hence to the interior of the insulating cylinder 34, along the arrows, and enters the evacuation channel 26.

The polished surface 41 of the rotor 2 is obtained by treating the concerned portion of the copper rotor by a chemical polishing process, for instance, by means of a bath in a well-known scouring solution which is used to etch the metal away at its surface. The reflective polished metal of the protective disc 42 is made, for instance, in stainless steel polished according to the above-mentioned process.

X-ray tubes, such as described above, can have anodes with diameters in excess of 250 mm, rotating at speeds up to 15,000 rpm, with tube potentials of 160 to 200 kilovolts, which results, for example, in an instantaneous power of 300 kilowatts (instead of the present 100 kilowatts) on an optical focal track of 2 mm width with an anode inclination of 12°. This permits intensive operation both in terms of power and cycle time without ever exceeding the thermal capacity of the anode which is of the order of 3,000,000 joules instead of the 2 – 300,000 joules in present X-ray tubes.

Furthermore, because the cathode lies on the same side as the rotor, the tube housing can be cylindrical at the side of the high voltage lines and thus permits placing it at the ends of the arms of a column of a radiological stand, and thus diminishing its space requirements.

What is claimed is:

1. A high-power X-ray tube including in combination an evacuated envelope; and within said envelope: a motor assembly including a fixed shaft attached to said envelope, a rotor with a rotatable shaft extending therefrom and bearing means for mounting said rotor and said rotatable shaft on said fixed shaft; a disc-shaped anode carried by said rotatable shaft, said anode being made of graphite and having a convex face facing away from its axis of rotation and coated on at least a major portion thereof by a layer of an X-ray emissive refractory metallic material having a much lower coefficient of thermal emissivity than its other, graphite face; and a cathode assembly for generating an electron beam directed toward said convex, coated face of said anode;

wherein the improvement, in view of reducing the transfer of heat from the anode toward the rotor and of providing an increased power output, further comprises in combination: means for mounting said anode on said rotatable shaft with its convex, coated face turned in the direction of said rotor and means for mounting said cathode assembly on said envelope on the same side of said anode as said rotor for facing said X-ray emissive layer-coated face, and wherein said fixed shaft is hollow and connected by its extremities to two opposite ends of said envelope for carrying a flow of a coolant within said fixed shaft, and said bearing means includes two bearings mounted on said fixed shaft with one bearing on each side of said anode, whereby the heat from said anode is evacuated mainly by radiation in directions opposite said rotor and said bearings are cooled by the coolant flow.

2. A high-power X-ray tube including in combination an evacuated envelope; and within said envelope: a motor assembly including a fixed shaft attached to said envelope, a rotor with a rotatable shaft extending therefrom and bearing means for mounting said rotor on said fixed shaft; a disc-shaped anode carried by said rotatable shaft, said anode being made of graphite, having a convex face and facing away from its axis of rotation and coated on at least a major portion thereof by a layer of an X-ray emissive refractory metallic material having a much lower coefficient of thermal emissivity than its other, graphite face; and a cathode assembly for generating an electron beam directed toward said convex, coated face of said anode; wherein the improvement, in view of reducing the transfer of heat from the anode toward the rotor and the bearings carrying said rotor and of providing an increased power output, further comprises in combination: means for mounting said anode on said rotatable shaft with its convex, coated face turned in the direction of said rotor and means for mounting said cathode assembly on said envelope on the same side of said anode as said rotor for facing said X-ray emissive layer coated face, whereby the heat from the anode is evacuated mainly by radiation in directions opposite said rotor.

3. X-ray tube as defined in claim 2, wherein the surface of said rotor facing the anode includes a polished reflecting portion over approximately one-fifth of its extent.

4. X-ray tube as defined in claim 2, further comprising a metallic disc, interposed between the anode and the rotor on said rotatable shaft, said disc being of large enough diameter to shield the rotor from thermal radiation emitted by the anode, and wherein at least the surface thereof facing the anode is a polished reflecting surface.

5. X-ray tube as defined in claim 2, wherein said fixed shaft is hollow and is connected to two opposite ends of said envelope, and said bearing means includes two bearings mounted to said fixed shaft with one bearing on each side of said anode plate, thereby concentrically mounting said rotor and said rotatable shaft to said fixed shaft.

* * * * *